US007033986B2

(12) United States Patent
Szewczyk

(10) Patent No.: US 7,033,986 B2
(45) Date of Patent: Apr. 25, 2006

(54) LIQUID DISH CLEANING COMPOSITIONS COMPRISING A MIXTURE OF ALKYL BENZENE SULFONATES AND ALKYL ETHER SULFATES

(75) Inventor: Gregory Szewczyk, Flemington, NJ (US)

(73) Assignee: Colgate-Palmolive Company, New York, NY (US)

( * ) Notice: Subject to any disclaimer, the term of this patent is extended or adjusted under 35 U.S.C. 154(b) by 110 days.

(21) Appl. No.: 10/650,420

(22) Filed: Aug. 28, 2003

(65) Prior Publication Data

US 2005/0049170 A1 Mar. 3, 2005

(51) Int. Cl.
*C11D 1/37* (2006.01)
*C11D 1/83* (2006.01)

(52) U.S. Cl. ..... 510/428; 510/123; 510/125; 510/235; 510/237; 510/253; 510/351; 510/352; 510/372; 510/426; 510/427; 510/514

(58) Field of Classification Search ..... 510/123, 510/125, 235, 237, 253, 352, 351, 372, 426, 510/427, 428, 514
See application file for complete search history.

(56) References Cited

U.S. PATENT DOCUMENTS 5,955,411 A * 9/1999 Gorlin ..... 510/237
5,998,347 A * 12/1999 D'Ambrogio et al. ..... 510/237
6,432,904 B1 * 8/2002 Suazon et al. ..... 510/438

* cited by examiner

*Primary Examiner*—Charles Boyer
(74) *Attorney, Agent, or Firm*—Bernard Lieberman

(57) ABSTRACT

A liquid dish cleaning composition with desirable cleansing properties comprising two $C_{8-18}$ ethoxylated alkyl ether sulfate surfactants, two anionic surfactant, an amine oxide surfactant, and water.

6 Claims, No Drawings

LIQUID DISH CLEANING COMPOSITIONS COMPRISING A MIXTURE OF ALKYL BENZENE SULFONATES AND ALKYL ETHER SULFATES

FIELD OF INVENTION

This invention relates to a liquid dish cleaning composition which has superior mildness and foam longevity while maintaining good foaming grease cutting properties.

BACKGROUND OF THE INVENTION

The present invention relates to novel light duty liquid detergent compositions with mildness, high foaming longevity and good grease cutting properties.

The prior art is replete with light duty liquid detergent compositions containing nonionic surfactants in combination with anionic and/or betaine surfactants wherein the nonionic detergent is not the major active surfactant. In U.S. Pat. No. 3,658,985 an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or diethanolamide. U.S. Pat. No. 4,259,204 discloses a shampoo comprising 0.8 to 20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition containing an alkali metal silicate, urea, glycerin, triethanolamine, an anionic detergent and a nonionic detergent. The silicate content determines the amount of anionic and/or nonionic detergent in the liquid cleaning composition. However, the foaming properties of these detergent compositions are not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to affect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylenepolyoxyethylene nonionic detergent, an anionic surfactant, a fatty acid alkanolamide and a polyoxyalkylene glycol fatty ester. But, none of the exemplified compositions contain an active ingredient mixture wherein the nonionic detergent is present in major proportion which is probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

SUMMARY OF THE INVENTION

It has now been found that a liquid dish cleaning composition can be formulated with four different anionic surfactants, an amine oxide surfactant, and water which has desirable cleaning properties and improved mildness and foam longevity.

An object of this invention is to provide a liquid dish cleaning composition which comprises two ethoxylated alkyl sulfate anionic surfactants, two sulfonate anionic surfactants, an amine oxide and water, wherein the composition does not contain any silicas, abrasives, acyl isoethionate, 2-hydroxy-4,2',4'-trichloridiphenyl ether, phosphoric acid, phosphonic acid, boric acid, alkali metal carbonates, alkaline earth metal carbonates, alkyl glycine surfactant, cyclic imidinium surfactant, or more than 3 wt. % of a fatty acid or salt thereof.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

This invention relates to a liquid dish cleaning composition which comprises approximately by weight:

(a) 1% to 6% of a sodium salt of a $C_8$–$C_{16}$ linear alkyl benzene sulfonate surfactant;

(b) 7% to 13% of a magnesium salt of a $C_8$–$C_{16}$ linear alkyl benzene sulfonate surfactant;

(c) 8% to 14% of an ammonium or sodium salt of an ethoxylated $C_8$–$C_{18}$ alkyl ether sulfate surfactant having 1 to 3 moles of ethylene oxide;

(d) 8% to 14% of an ammonium or sodium salt of an ethoxylated alkyl ether sulfate surfactant having 5 to 10 moles of ethylene oxide;

(e) 3% to 10% of an amine oxide surfactant;

(f) 0 to 5%, more preferably 0.5% to 4% of a hydroxy containing organic acid;

(g) 0 to 10% of at least one solubilizing agent; and (h) the balance being water, wherein the composition has a pH of about 3 to about 7, more preferably about 6 to about 7 and has a viscosity of 100 to 1,000 cps, more preferably 200 to 600 cps at 25° C. using a #21 spindle at 20 rpm as measured on a Brookfield RVTDV-11 viscometer, wherein the composition does not contain any grease release agents such as choline chloride or buffering system which is a nitrogenous buffer which is ammonium or alkaline earth carbonate, guanidine derivates, alkoxylalkyl amines and alkyleneamines $C_3$–$C_7$ alkyl and alkenyl monobasic and dibasic acids such as $C_4$–$C_7$ aliphatic carboxylic diacids which do not contain a hydroxy group, boric acid, phosphoric acid, amino alkylene phosphonic acid and alkyl polyglucoside surfactants and the composition is pourable and not a gel has a complex viscosity at 1 rads$^{-1}$ of less than 0.4 Pascal seconds.

The anionic sulfonate surfactants which may be used in the detergent of this invention are selected from the consisting of water soluble and include the sodium, potassium, ammonium, magnesium and ethanolammonium salts of linear $C_8$–$C_{16}$ alkyl benzene sulfonates; $C_{10}$–$C_{20}$ paraffin sulfonates, alpha olefin sulfonates containing about 10–24 carbon atoms and $C_8$–$C_{18}$ alkyl sulfates and mixtures thereof.

Examples of suitable sulfonated anionic detergents are the well known higher alkyl mononuclear aromatic sulfonates, such as the higher alkylbenzene sulfonates containing 9 to 18 or preferably 9 to 16 carbon atoms in the higher alkyl group in a straight or branched chain, or $C_{8-15}$ alkyl toluene sulfonates. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

Each of the two $C_{8-18}$ ethoxylated alkyl ether sulfate surfactants used in the instant compositions have the structure $$R—(OCHCH_2)_nOSO_3^-M^+$$

wherein R is an alkyl group having about 8 to about 18 carbon atoms, more preferably 12 to 15 and natural cuts, for example, $C_{12-14}$ or $C_{12-16}$ and M is an ammonium cation or a metal cation, most preferably sodium. In one of ethoxylated alkyl ether sulfate surfactants, the value of n is 1 to 2 and in the other ethoxylated alkyl ether sulfate surfactant n is 5 to 10.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether sulfates contain 12 to 15 carbon atoms in the alcohols and in the alkyl groups thereof.

Amine oxide semi-polar nonionic surfactants comprise compounds and mixtures of compounds having the formula:

$$R_1(C_2H_4O)_nN(R_2)(R_3)\rightarrow O$$

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl, and n is from 0 to 10. Particularly preferred are amine oxides of the formula:

$$R_1—N(R_2)(R_3)\rightarrow O$$

wherein $R_1$ is a $C_{12-16}$ alkyl and $R_2$ and $R_3$ are methyl or ethyl. The above ethylene oxide condensates, amides, and amine oxides are more fully described in U.S. Pat. No. 4,316,824 which is hereby incorporated herein by reference.

The instant composition can optionally contain 0 to 10 wt. %, more preferably 0.5 wt. % to 8 wt. % of a $C_{12-14}$ alkyl monoalkanol amide such as lauryl monoalkanol amide.

The water-soluble zwitterionic surfactant, which can be optionally used at a concentration of 7 wt. % to 13 wt. % is a water soluble betaine having the general formula:

$$R_1—N(R_2)(R_3)—R_4—COO—$$

wherein $R_1$ is an alkyl group having 10 to 20 carbon atoms, preferably 12 to 16 carbon atoms, or the amido radical:

$$R—C(=O)—N(H)—(CH_2)_a—$$

wherein R is an alkyl group having 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N,N-dimethyl-ammonia) acetate, coco dimethyl betaine or 2-(N-coco N,N-dimethylammonio) acetate, myristyl dimethyl betaine, palmityl dimethyl betaine, lauryl diemethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine.

The hydroxy containing organic acid is ortho hydroxy benzoic acid or preferably a hydroxy aliphatic acid selected from the group consisting of lactic acid, citric acid, salicylic acid and glycolic and mixtures thereof.

Polyethylene glycol which can be optionally used in the instant composition at a concentration of 0.5 wt. % to 10 wt. % has a molecular weight of 200 to 1,000, wherein the polyethylene glycol has the structure $$HO(CH_2CH_2O)_nH$$

wherein n is 4 to 52. The concentration of the polyethylene glycol in the instant composition is 0 to 7 wt. %, more preferably 0.1 wt. % to 5 wt. %.

The instant light duty liquid compositions can contain about 0 wt. % to about 10 wt. %, more preferably about 0.5 wt. % to about 8 wt. %, of at least one solubilizing agent selected from the group consisting of a $C_{2-5}$ mono, dihydroxy or polyhydroxy alkanols such as ethanol, isopropanol, glycerol ethylene glycol, diethylene glycol, propylene glycol, and hexylene glycol and mixtures thereof and alkali metal cumene, toluene or xylene sulfonates such as sodium cumene sulfonate and sodium xylene sulfonate. The solubilizing agents are included in order to control low temperature cloud clear properties. Urea can be optionally used at a concentration of 0.1% to 7 wt. %. Additionally, the instant compositions can contain 0 to 3 wt. %, more preferably 0.5 wt. % to 2 wt. % of an alkali metal halide such as sodium chloride.

The instant formulas explicitly exclude alkali metal silicates and alkali metal builders such as alkali metal polyphosphates, alkali metal carbonates, alkali metal phosphonates and alkali metal citrates because these materials, if used in the instant composition, would cause the composition to have a high pH as well as leaving residue on the surface being cleaned.

The final essential ingredient in the inventive compositions having improved interfacial tension properties is water. The proportion of water in the compositions generally is in the range of 50% to 95%.

The liquid cleaning composition of this invention may, if desired, also contain other components either to provide additional effect or to make the product more attractive to the consumer. The following are mentioned by way of example: Colors or dyes in amounts up to 0.5% by weight; bactericides in amounts up to 1% by weight; HEDTA for color improvement under stressed sun conditions, up to 1% and pH adjusting agents, such as sulfuric acid or sodium hydroxide, as needed.

The instant compositions can contain 0 to 0.5 wt. %, more preferably 0.05 wt. % to 0.3 wt. % of a chelating agent such as penta sodium pentetate. The instant composition can also contain 0 to 10 wt. %, more preferably 0.1 wt. % to 9 wt. % of hydrogen peroxide.

Preservatives which can be optionally used in the instant compositions at a concentration of 0 wt. % to 3 wt. %, more preferably 0.01 wt. % to 2.5 wt. % are: benzalkonium chloride; benzethonium chloride,5-bromo-5-nitro-1,3dioxane; 2-bromo-2-nitropropane-1,3-diol; alkyl trimethyl ammonium bromide; N-(hydroxymethyl)-N-(1,3-dihydroxy methyl-2,5-dioxo-4-imidaxolidinyl-N'-(hydroxy methyl) urea; 1-3-dimethyol-5,5-dimethyl hydantoin; formaldehyde; iodopropynl butyl carbamate, butyl paraben; ethyl paraben; methyl paraben; propyl paraben, mixture of methyl isothiazolinone/methyl-chloroisothiazoline in a 1:3 wt. ratio; mixture of phenoxythanol/butyl paraben/methyl paraben/propylparaben; 2-phenoxyethanol; tris-hydroxyethyl-hexahydrotriazine; methylisothiazolinone; 5-chloro-2-methyl-4-isothiazolin-3-one; 1,2-dibromo-2,4-dicyanobutane; 1-(3-chloroalkyl)-3,5,7-triaza-azoniaadamantane chloride; and sodium benzoate.

In final form, the instant compositions exhibit stability at reduced and increased temperatures. More specifically, such compositions remain clear and stable in the range of 0° C. to 50° C., especially 5° C. to 43° C. Such compositions exhibit a pH of 3 to 7.5, more preferably 6 to 7. The liquid compositions are readily pourable and exhibit a viscosity in the range of 6 to 300 milliPascal. second (mPas.) as measured at 25° C. with a Brookfield RVTDV-11 Viscometer using a #21 spindle rotating at 20 RPM. Preferably, the viscosity is maintained in the range of 10 to 200 mPas.

The following examples illustrate the liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared by simple mixing procedure:

| Surfactant | Standard Reference Formula | A | B | C | D |
|---|---|---|---|---|---|
| MgLAS | 9 | 9 | 9 | 9 | 9 |
| NaLAS | 3 | 3 | 3 | 3 | 3 |
| NH4AEOS 1.3 mole EO | 11.5 | 11.5 | 11.5 | 11.5 | 11.5 |
| Amine Oxide | 5.417 | 5.417 | 5.417 | 5.417 | — |
| Betaine | — | — | — | — | 5 |
| APG | 10 | — | — | — | |
| NaAEOS 5EO | — | 10 | — | — | 10 |
| NaAEOS 7EO | — | — | 10 | — | — |
| NaAEOS 9EO | — | — | — | 10 | — |
| SXS hydrotrope | 1.5 | | | | |
| Salt | — | 1 | 1 | 1 | 1 |
| DMDMH | .11 | .11 | .11 | .11 | .11 |
| Pentasodium pentetate | .125 | .125 | .125 | .125 | .125 |
| Ethanol | 6.1 | 6.1 | 6.1 | 6.1 | 6.1 |
| pH | Neutral | Neutral | Neutral | Neutral | Neutral & Acidic |
| Grease (% Removed) | 18 | 17.8 | 17.3 | 17 | 18.2 |
| Foam longevity (# Miniplates) | 29 | 33 | 32 | 32 | 32 |
| Foam volume (Initial/soil) | 355/160 | 355/190 | 360/185 | 355/185 | 375/190 |
| Mildness | STD | Better | Superior | Superior | unknown |

The Cup test measures the grease removal under soaking conditions. 6 gr. of warm liquid beef tallow is applied on a 250 ml plastic cup. It is allowed to solidify for at least 3 hours. Warm solutions (115F) of LDL products at 0.267% concentration were poured on the plastic cups containing the grease. After 15 minutes they are emptied, and allowed to dry. The weight of the grease removed during soaking is measured.

The foam volume test is an inverted cylinder test in which 100 ml of 0.0335 wt. % of the LDL composition in 150 ppm Mg/CaCO3 hardened water is placed in a stoppered graduated cylinder (500 ml) and inverted 40 cycles at a rate of 30 cycles/minute. After 40 inversions, the foam height in the graduated cylinder is measured in ml's. After the volume is measured for this initial 40 cylinder inversions, the cylinder stopper is removed and 175 microliters of whole milk is added to the solution. The cylinder is then inverted for another 40 cycles and a foam volume with soil is measured. The values provided above include the 100 ml's of LDL solution inside the cylinder.

The # of miniplates is measured using an automated miniplate test. The procedure is described in great detail in U.S. Pat. No. 4,556,509. Briefly, the test is used to determine the number of theoretical plates that can be washed in a detergent solution until the foam disappears. This test is used to demonstrate the improvement in cleaning efficiency as gauged by foam volume and foam stability. In the automatic miniplate dishwashing test, foam is generated in a detergent solution by the action of an agitating brush. The foam is electronically measured by reflectance of the solution surface as Crisco (vegetable shortening) soil is added to the detergent solution at a steady rate. The disappearance of the foam determines the endpoint of the test, and the number of miniplates is then calculated based on foam duration and the rate of soil addition. For our tests the detergent solution was made at 3.333 wt. % with 150 ppm Mg/CaCO3 hardness, and was initially heated to 47C (116.6F) at the start of soil addition.

What is claimed:

1. A liquid dish cleaning composition which comprises approximately by weight:

(a) 1% to 6% of a sodium salt of a $C_8$–$C_{16}$ linear alkyl benzene sulfonate surfactant;

(b) 7% to 13% of a magnesium salt of a $C_8$–$C_{16}$ linear alkyl benzene sulfonate surfactant;

(c) 8% to 14% of an ammonium or sodium salt of an ethoxylated $C_8$–$C_{18}$ alkyl ether sulfate surfactant having 1 to 30 moles of ethylene oxide;

(d) 8% to 14% of an ammonium or sodium salt of an ethoxylated alkyl ether sulfate surfactant having 5 to 10 moles of ethylene oxide;

(e) 3% to 10% of an amine oxide surfactant;

(f) 0.5% to 10% of at least one solubilizing agent; and (g) water, wherein the composition has a pH of 3 to 7 and has a viscosity of 100 to 1,000 cps at 25° C. using a #21 spindle at 20 rpm as measured on a Brookfield RVTDV-II viscometer.

2. The composition of claim 1, wherein the composition also contains a hydroxy containing organic acid which is selected from the group consisting of orthohydroxy benzoic acid, citric acid, glycolic acid, acetic acid and lactic acid and mixtures thereof.

3. The composition of claim 1, wherein the composition also contains a preservative.

4. The composition of claim 3, wherein the composition also contains a chelating agent.

5. The composition of claim 1, wherein the composition contains a peroxide source.

6. The composition of claim 1, wherein the composition contains polyethylene glycol.

* * * * *

UNITED STATES PATENT AND TRADEMARK OFFICE

CERTIFICATE OF CORRECTION

PATENT NO. : 7,033,986 B2
APPLICATION NO. : 10/650420
DATED : April 25, 2006
INVENTOR(S) : Szewczyk It is certified that error appears in the above-identified patent and that said Letters Patent is hereby corrected as shown below:

In the Specification:

Col. 2, line 53 delete "1 to 3 moles" and replace with --1 to 30 moles--

Signed and Sealed this

Twenty-second Day of July, 2008

JON W. DUDAS
*Director of the United States Patent and Trademark Office*